United States Patent [19]

Reinehr et al.

[11] Patent Number: 5,013,502

[45] Date of Patent: May 7, 1991

[54] CONTINUOUS PRODUCTION OF ACRYLONITRILE FILAMENTS AND FIBERS FROM SPINNING MATERIAL OF LOW RESIDUAL SOLVENT CONTENT

[75] Inventors: Ulrich Reinehr; Rolf-Burkhard Hirsch; Hermann Josef Jungverdorben; Joachim Dross, all of Dormagen, Fed. Rep. of Germany

[73] Assignee: Bayer Aktiengesellschaft, Leverkusen, Fed. Rep. of Germany

[21] Appl. No.: 409,550

[22] Filed: Sep. 19, 1989

[30] Foreign Application Priority Data

Sep. 28, 1988 [DE] Fed. Rep. of Germany ..... 3832870

[51] Int. Cl.[5] ..... D01F 6/18

[52] U.S. Cl. ..... 264/103; 264/130; 264/129; 264/151; 264/168; 264/206; 264/210.8; 264/211.15; 264/211.16; 264/211.17; 264/289.6; 264/290.5

[58] Field of Search ..... 264/103, 168, 206, 130, 264/210.8, 148, 151, 211.15, 211.16, 211.17

[56] References Cited

U.S. PATENT DOCUMENTS

| | | | |
|---|---|---|---|
| 3,991,153 | 11/1976 | Klausner et al. | 264/211 |
| 4,108,845 | 8/1978 | Reinehr et al. | 264/206 |
| 4,457,884 | 7/1984 | Reinehr et al. | 264/206 |
| 4,508,672 | 4/1985 | Reinher et al. | 264/206 |
| 4,622,195 | 11/1986 | Bueb et al. | 264/233 |
| 4,650,624 | 3/1987 | Reinehr et al. | 264/206 |
| 4,804,511 | 2/1989 | Piper et al. | 264/206 |
| 4,842,793 | 6/1989 | Reinehr et al. | 264/205 |
| 4,852,021 | 8/1989 | Reinehr et al. | 28/263 |

FOREIGN PATENT DOCUMENTS

| | | |
|---|---|---|
| 0098485 | 1/1984 | European Pat. Off. . |
| 1012027 | 7/1957 | Fed. Rep. of Germany . |
| 1435611 | 9/1973 | Fed. Rep. of Germany . |
| 2504079 | 8/1976 | Fed. Rep. of Germany . |
| 2627457 | 1/1977 | Fed. Rep. of Germany . |
| 3225266 | 1/1984 | Fed. Rep. of Germany . |
| 3418943 | 11/1985 | Fed. Rep. of Germany . |
| 3424343 | 1/1986 | Fed. Rep. of Germany . |
| 3515091 | 10/1986 | Fed. Rep. of Germany . |
| 3630244 | 3/1988 | Fed. Rep. of Germany . |
| 3631905 | 3/1988 | Fed. Rep. of Germany . |

*Primary Examiner*—Hubert C. Lorin

*Attorney, Agent, or Firm*—Sprung Horn Kramer & Woods

[57] ABSTRACT

A process for the production of crimped filaments and fibers of acrylonitrile polymers of copolymers containing at least 40% by weight acrylonitrile units, by dry spinning from highly polar solvents, where the filaments are brought to extremely low solvent contents in the actual spinning tube by a minimum of superheated steam prepared in the absence of water at very high spinning tube temperatures and spinning gas temperatures, but are cooled to low filament temperatures in the spinning tube by application of water or aqueous finishes in a quantity equivalent to more than 10% by weight moisture. In this way, spun PAN filaments of good natural color are safely obtained, in which there is no washing stage and no drying stage. Acrylic fibers and filaments combining a vacuolestable structure with a very high degree of whiteness and gloss are thus obtained with densities of at least 1.180 g/cm$^3$, giving shrinkage-free to high-shrinkage fibers, depending on the aftertreatment applied.

15 Claims, No Drawings

CONTINUOUS PRODUCTION OF ACRYLONITRILE FILAMENTS AND FIBERS FROM SPINNING MATERIAL OF LOW RESIDUAL SOLVENT CONTENT

This invention relates to a process for the production of crimped filaments and fibers of acrylonitrile polymers or copolymers containing at least 40% by weight acrylonitrile units, preferably more than 85% by weight and, more preferably, at least 92% by weight acrylonitrile units by dry spinning from highly polar solvents, where the filaments are brought to extremely low solvent contents (preferably <1% by weight) in the actual spinning tube by a minimum of superheated steam prepared to contain no water at very high spinning tube temperatures and spinning gas temperatures, but are cooled to low filament temperatures in the spinning tube by application of water or aqueous finishes in a quantity equivalent to more than 10% by weight moisture. In this way, spun PAN filaments of good natural color are safely obtained, preferably being directly delivered to a continuous aftertreatment process, in which there is no washing stage and no drying stage in contrast to conventional aftertreatment processes. Acrylic fibers and filaments combining a vacuole-stable structure with a very high degree of whiteness and gloss are thus obtained with densities of at least 1.180 g/cm$^3$, giving shrinkage-free to high-shrinkage fibers, depending on the aftertreatment applied.

Acrylic fibers are normally produced by wet spinning or dry spinning and, according to reports, may even be prepared by melt spinning. Whereas, in the production of acrylic fibers by wet spinning and melt spinning, continuous processes have been used for some time, for example the wet spinning process according to Textil technik 26 (1976), pages 479–483 or the melt spinning process according to DE-A-2 627 457, continuous processes for the production of acrylic fibers by dry spinning have only recently been published. Thus, DE-A3 225 266 describes a dry spinning process using air as the spinning gas, in which this problem can be solved by reducing the amount of solvent in the spun material to below 40% by weight and more especially to between 2 and 10% by weight, based on dry fiber weight, in the spinning tube. To obtain the desired low residual solvent contents in the spun material, the spinning process is carried out at low spinning rates and, hence, with high residence times in the spinning tube or at high spinning tube and spinning air temperatures where this was possible. However, low spinning speeds mean a considerable reduction in spinning efficiency and are therefore undesirable. The reduction in spinning efficiency at low spinning rates can be (partly) compensated by using spinnerets having large numbers of bores. On the other hand, high spinning tube and spinning air temperatures result in considerable damage to the natural color of the tow and in hardening of the fiber surface. In addition, limits imposed for safety reasons on tube, air or filament temperatures are exceeded. Although a gradual improvement can again be obtained by means of stabilizers, for example by the addition of ethylenediamine tetraacetic acid to the spinning solution, as described in EP 3 418 943, it is still totally inadequate.

In the dry spinning of acrylic fibers with air as the spinning gas medium, it has not hitherto been possible to reduce the spinning solvent content to significantly below 2% by weight. As the last quantities of spinning solvent are lost in the spinning tube, the filaments develop electrostatic charges, turn yellow and carbonize with an increased fire risk in the tube.

Continuous processes for the production of acrylic fibers and, in particular, high-shrinkage acrylic fibers by dry spinning have only recently been published. "High-shrinkage filaments and fibers" are understood to be filaments and fibers having a boiling-induced shrinkage of more than 35%. Fibers such as these are produced with low degrees of stretching and at low stretching temperatures (DE-A 1 435 611 and 2 504 079).

EP-A 98 485 describes a process for the production of high-shrinkage fibers in which the spinning solution used has a certain viscosity, the solvent content in the spun material is reduced below certain levels in the spinning tube, the filaments are treated before stretching with a preferably aqueous finish containing a lubricant and an antistatic agent, although the water uptake (moisture) of the filaments remains below a certain value, and the filaments are not contacted with any other solvent extraction liquid either before or during stretching. The crucial requirement in this known process is that the spun material, i.e. the filament, leaving the spinning tube should have a residual solvent content of less than 10% by weight and more preferably from 2 to 5% by weight, based on fiber dry weight, because spun material having higher residual solvent contents, for example dimethyl formamide, blocks during subsequent stretching on godets at tow temperatures of around 100° C. or, alternatively, the material undergoes unwanted cold elongation, i.e. uneven and incomplete stretching under variable conditions.

DE-A 3 630 244 describes another process for the continuous production of high-shrinkage acrylic fibers. In this process, the spinning solvent is partially evaporated in the spinning tube, the filaments are treated in the spinning tube or immediately after leaving the spinning tube with a finish which provides them with a moisture content of at most 10% by weight, after which the filaments are freed from residual solvent before stretching by aftertreatment in the substantial absence of tension with superheated steam at 105° to 150° C. or with hot air at at least 200° C. over a residence time of at least 3 minutes to such an extent that, after this treatment, values below 2% by weight and preferably 1% by weight are obtained. The tows are then further stretched in ratios of 1:2 to 1:4 at temperatures of 90° to 120° C.

The present invention addresses the following problem: among manufacturers of dry-spun acrylic fibers, there is a wish to reduce the residual solvent content of the spun material after leaving the spinning tube to below 2% by weight and preferably to below 1% by weight, based on polymer solids dry weight, because this would afford many advantages in practice. On the one hand, the production process as a whole could be considerably simplified because a large part of the present cost-intensive process steps, such as for example slow spinning, washing and drying or steaming of the spinning material to remove residual solvent, would become unnecessary; on the other hand, the spinning solvent could be directly recovered at the earliest possible stage so that it would not have to be carried through several process stages or separately recovered. This would in turn afford considerable ecological and economic advantages because there would no longer be any need for expensive encapsulation and sealing to prevent the spinning solvent from escaping into the machinery used for the aftertreatment stage.

It has now surprisingly been found that, despite the hitherto unresolved difficulties described in the foregoing, polyacrylonitrile fibers and filaments can be dry-spun with residual solvent contents below 2% by weight and preferably below 1% by weight, based on polymer solids, and aftertreated, optionally directly and continuously, if, instead of air or inert gas, superheated steam is used in certain quantities and under certain conditions as the spinning gas, the filaments are moistened in the spinning tube to a moisture content of more than 10% by weight and the spun material is continuously worked up in the after-treatment stages (no washing or drying stages) to filaments and fibers. The process uses tows of high sliver weight and high production rates.

Although the production of PAN filaments by dry spinning with superheated steam was once mentioned some time ago in the prior art (DE-AS 1 012 027), no teaching with respect to technical procedure could be derived from claim 1, particularly for the production of low-solvent filaments. Although attempts to dry spin PAN filaments using superheated steam in accordance with DE-AS 1 012 027 showed that it was possible to obtain DMF contents in the spun material below about 2% by weight at high spinning tube temperatures of 240° C., with large amounts of steam amounting to at least 2.0 kg steam per kg PAN solids and at high steam temperatures, for example of 400° C., it was also found that the filaments after leaving the tubes were extremely yellow and carbonized and even glowed, so that the bobbins had to be quenched with water. Attempts to obtain satisfactory spinning by increasing the quantity of spin finish applied beneath the spinning tube were also unsuccessful (see Comparison Examples 3*a* and 3*b*).

It would seem that, under the high predetermined energy loads in the spinning tube required for removing most of the spinning solvent, the filaments reached temperatures which lead to carbonization and glowing of the spun material on contact with air inside the tube. As shown by measurements of filament temperature carried out with a KT 15 radiation thermometer (manufactured by Heimann GmbH, Wiesbaden, Federal Republic of Germany), which does not come into contact with the filaments, the filaments reach temperatures at the tube exit of more than 150° C. (cf. for example 3*a*).

It has now surprisingly been found that these difficulties can be avoided if, before coming into contact with atmospheric oxygen, the spun filaments are treated with water or with an oil-containing aqueous finish in the spinning tube, preferably at the lower end thereof, under the intensive thermal stresses (very high tube temperatures plus high steam temperature), so that the filament temperatures are below 130° C. and preferably below 120° C. when the spun filaments of low residual solvent content leave the tube.

According to the present invention, it is possible for the first time by using superheated steam in the dry spinning of PAN fibers safely to produce filaments having low residual solvent contents (in the case of dimethyl formamide for example, distinctly below 2% by weight and preferably below 1% by weight and less) and at the same time, a good natural color.

Vertically adjustable slot dies of the type described in DE 3 515 091 are suitable devices for finishing the filaments in the spinning tube. By adequately wetting the spun filaments with water or, preferably, an aqueous finish in the spinning tube, it is thus possible to control the surface temperature of the filaments in such a way that the spun PAN filaments do not glow or develop electrostatic charges (above all on leaving the tube). Spinning tests have shown that the minimum moisture which has to be applied to the spun filaments not to exceed filament temperatures of 130° C., as measured at the tube exit, amounts to more than 10% by weight, based on PAN solids. The spun material obtained at only slightly higher temperatures and with a lower moisture content of the filaments is rough and brittle with increased sliver stiffness and poor sliver cohesion. The sliver cohesion of the individual filaments is understood to be the estate at which the individual filaments, after wetting and subsequent bundling in the spinning tube, are present as a compact and homogeneous bundle with no random orientation of the individual filaments and without the individual filaments splitting during rewinding or at guide rollers. At even higher filament temperatures, the filaments are in danger of glowing through the presence of air. In addition to water, a mixture of a lubricant and an antistatic agent with a concentration of, for example, 40 g/l in water has proved to be in particularly preferred finish. Through the application of this finish, the spun filaments may be directly further processed, for example by stretching, crimping, shrinking and cutting, as will be discussed hereinafter. Suitable lubricants are, for example, glycols, silicones or ethoxylated fatty acids, alcohols, esters, amides and alkyl ether sulfates. Suitable antistatic agents are, for example, cationic, anionic or nonionic compounds such as, for example, long-chain, ethoxylated, sulfonated and neutralized alcohols.

The minimum amount of steam needed depends to some extend on the (generally predetermined) tube geometry, particularly the tube diameters (generally 250–500 mm and more especially 275–300 mm). For diameters of 280 mm, it amounts for example to at least 20 kg/h, larger amounts being necessary with larger diameters (at least 30 kg/h for a diameter of 500 mm). However, certain PAN solids/steam quantity rations of $1:\geqq 3$ also have to be maintained. Breaks occur below the die. To achieve the desired low residual solvent contents of preferably less than 1% by weight in the spinning tube, PAN solids/steam rations of at least 1:3 and higher (cf. Table 1 in the Examples) have proved effective for predetermined tube temperatures of >230° C., preferably at least 230° to 250° C. and, more preferably, 235° to 245° C. and for predetermined steam temperature of, for example, >360° C. and preferably at least 400° C.

In the steam spinning of PAN fibers and filaments, it is also important to ensure that the superheated steam used for spinning has been prepared to contain no water. Droplets of water adversely affect the spinning process and result in sheets of filaments breaking in clusters beneath the die. Droplet-free spinning steam is obtained, for example, by removing water from and then reducing 15 bar wetting steam, subsequently passing it through heat exchangers and only then delivering it to the spinning tube.

One advantage of the process according to the invention is possible based inter alia on the fact that steam carries much more energy than air and inert gases, as reflected in its specific heat which is twice as high as that of air (specific heat: steam at 200° C.=0.460 kcal/kg°C.; air at 200° C.=0.245 kcal/kg/°C.). In addition, the fact that far higher spinning gas and spinning tube temperatures are used in steam spinning then in dry spinning with air is of crucial importance. Thus, spinning steam temperatures of 400° C. and higher and spinning tube temperatures of >230° C., more especially in the range from 235° to 245° C. and generally of the order of 240° C. can be established without any danger of explosive mixtures with the solvent being formed in the spinning tube. For practical reasons, an upper limit is imposed on the spinning tube temperatures and spun material temperatures by the ignition temperature for polyacrylonitrile which is approximately 250° C. (cf. U. Einsele "Brennverhalten von Synthesefasern [Burning Behavior of Synthetic Fibers ]", Melliand 53 (1972), pages 1400). Any contact of the filaments with the metal walls of the tube at around 250° C. results in glowing of the filaments. Accordingly, the basically even higher possible temperatures are avoided for safety reasons.

Another major advantage of the present invention is the excellent whiteness of the fibers because, as already mentioned in DE-AS 1 012 027, inclusions of oxidizing air in the spinning tube are ruled out, although in the process according to the invention the filaments additionally leave the tube in a moistened, cooled state so that they undergo neither self-ignition nor yellowing on contact with ambient air, although they were exposed to considerably higher temperatures in the crucial stage of the spinning process. The presence of steam in the spinning tube also enables the filaments to leave the tube at a higher temperature than is possible where air is used as the spinning gas.

In the process according to the invention, the spinning gas is introduced above the spinneret, as is normally the case, and flows parallel to the spun filaments, optionally inwards and outwards. In another preferred embodiment of dry spinning, the spinning gas is introduced into the upper part of the tube and flows transversely outwards over the filaments through a cylindrical gas distributor (cf. DE-A 3 424 343).

In another embodiment, the process according to the invention may also be integrated with advantage into a continuous spinning and aftertreatment process to the finished filament or fiber, a number of aftertreatment steps, such as washing and drying, being unnecessary, as mentioned at the beginning, and the process as a whole being shortened and simplified. Through elimination of the washing steps, the quantity of finish (oil) applied can be considerably reduced, in spite of which running properties (even during subsequent yarn spinning) are actually improved along with storage behavior.

The steam-spun filaments ("tube slivers"), spun for example in a spinning machine with 60 spinning stations (60 spinning tubes), which were finished inside the spinning tubes in accordance with the invention and have only a negligible content of residual spinning solvent, for example less than 1% by weight in the case of DMF, may be directly stretched over pairs of rollers or godets after leaving the spinning tube and after having been continuously combined to form a tow and, depending on the speed of the travelling tow, may be delivered to a steam-operated blow crimper or to a (high-performance) stuffer box crimper. The crimped tows, which preferably have a sliver weight of more than 100,000 dtex, are then exposed, optionally in a dwell zone in the form of a tube or box, to the crimping steam of the blow crimper or to the superheated steam and/or hot air of the stuffer box, so that they can partly or completely relax (shrink). After passing through a cooling zone, the tow is either deposited as an endless ribbon (for subsequent separation on a breaking converter, for example on a Seydel breaking machine) or, optionally, delivered to a (rotor) cutting unit and the staple fibers formed are compressed into bales (both forms are commercially available).

High-shrinkage (HS) filaments and fibers with a boiling-induced shrinkage of more than 35% can also be produced by the spinning process according to the invention providing crimping is carried out in a stuffer box crimper and the stretched or crimped tows (>100,000 dtex), after passing through a cooling zone, are delivered to a (rotor) cutting unit and the staple fibers formed are packed (in bales). Stretching is carried out before crimping (for high-shrinkage fibers) in a relatively narrow range of 1:2.5 to 1:4.0-fold at filament temperatures of 90° to 120° C. The fiber strengths of HS fibers amount to at least 1.5 cN/dtex, depending on the degree of stretching.

The process according to the invention is distinguished by the simplicity of its process steps, i.e., a very favorable economy factor is obtained in terms of the space, energy and personnel required and also from the ecology standpoint. It is also variable in regard to the properties of the filaments (high-shrinkage filaments, shrinkage filaments or substantially fully shrunk filaments), depending on the type of aftertreatment applied. The amount of finish applied to HS fibers, which is normally between 2 and 5% by weight, can be considerably reduced, for example to below 1.0%, preferably to below 0.5% and more preferably to below 0.4% (without water).

Accordingly, the present invention relates more particularly to a process for the production of filaments and (preferably) fibers of acrylonitrile polymers containing at least 40% by weight, preferably more than 85% by weight and, more preferably, more than 92% by weight acrylonitrile units by optionally direct and continuous spinning and aftertreatment, in which a spinning solution of the polymer in highly polar organic solvents, preferably DMF, is spun with superheated steam in a spinning tube, most of the spinning solvent is evaporated in the spinning tube and, after finishing, the tow obtained by combining several filaments is subjected, optionally directly, to continuous aftertreatment by stretching, crimping, optionally complete or partial shrinking and, optionally, cutting to fibers, characterized in that (a) the fibers are spun at outputs of <20 kg/tube/hour, (b) superheated steam substantially free from water droplets is used as the spinning gas, (c) the amount of spinning steam used amounts to at least 20 kg/tube/hour and preferably to between 35 and 80 kg/tube/hour, (d) the ration by weight of PAN solids to the throughput of spinning steam is at least 1:3 and preferably from 1:3 to 1:5, (e) the spinning steam temperature is at least 360° C., preferably 400° C. and higher, (f) the spinning tube temperature is at least 230° C., preferably from 235° to 250° C. and more preferably from 240° to 245° C., (g) and the filaments are finished at the lower end of the spinning tube either with water or with an aqueous, optionally oil-containing preparation containing an antistatic agent in such a way that, for bundling to promote tow cohesion, the moisture content of the filaments is more than 10% by weight, based on fiber solids, and the filament temperature on leaving the spinning tube is at more 130° C. and preferably below 120° C.,
and in that the spun filaments are continuously aftertreated, optionally directly.

The process comprises in particular continuously treating the tows—optionally combined from several tubes—after spinning by stretching (without aqueous baths), crimping, optionally shrinking and, optionally, cutting, the tows coming into contact with no other washing or extraction liquid for the spinning solvent than the water of the finish in the spinning tube throughout the entire process, the tow temperature during stretching being at least 90° C. (for HS fibers) or at least 105° C. (for non-HS fibers) and preferably from 90° to 120° C. for HS fibers and from 110° to 130° C. for non-HS fibers and the stretching ratio being from 1:2 to 1:15 and preferably from 1:3 to 1:12; high-shrinkage fibers are stretched under different conditions, as stated above (1:2.5 to 1:4 at <90° to 120° C.).

Stretching is generally followed by crimping of the tow, preferably in a (high-speed) stuffer box crimper or, more particularly, in a steam-operated blow crimper, the shrinkage of the filaments being eliminated partly (to <35%) or almost completely (0 to 3% shrinkage) by subsequent treatment of the filaments with hot air or steam, preferably with steam from the crimper.

The process may also be carried out in such a way that, after stretching in a ratio of only 1:2.5 to 4.0 at filament temperatures of 90° to 120° C., the tow is crimped in a stuffer-box crimper and then cooled and cut, a high-shrinkage fiber with >35% shrinkage being obtainable in this way.

The substantially solvent-free filaments and fibers, which are also substantially dry (for example moisture content below 1% by weight water), may also be dry-crimped, giving a more stable crimp than fibers containing solvents and/or relatively high water contents. Dry-crimped, substantially moisture-free fibers which have not been too highly finished can be processed to yarns by secondary spinning at higher speeds and with better yarn yields. The substantially dry fibers with very little finish obtained after processing can be stored almost indefinitely. This has not hitherto been the case with high-shrinkage types containing, for example, from 2 to 3% by weight finish and from 3 to 7% by weight moisture. As a result, it was not possible, for example, to ship HS fibers in containers or the like in countries where the temperatures rise during transport. This limitation does not apply to the high-shrinkage fibers produced in accordance with the invention which is a considerable advantage.

The speeds of 150 to 500 m/minute typical of dry spinning may readily be achieved in the process according to the invention where the filaments are stretched to between 200 and 400%. It was thus possible to achieve final speeds of preferably 300 to 1200 m/minute which can still be handled in continuous processing.

HS fibers are preferably crimped in a stuffer box. For production speeds above 200 m/minute, it is preferred to use a special type of stuffer box of the type described in German patent application DE-A 3 631 905. The crimped tow is then cut to staple fibers and baled. Since, in addition, high-shrinkage fibers can be dry-crimped, extremely high adhesion and a very high carding rate of 100 m/minute or higher, hitherto unknown for high-shrinkage acrylic fibers, are also obtained in secondary spinning. Another advantage of dry thermal stretching in the extremely favorable staple distribution with extremely low short-fiber and long-fiber components. These advantages cannot be obtained in conventional processed because of the intermediate washing steps involved. In addition, the fibers show excellent whiteness.

The Berger whiteness ($W_B$) was determined by measurement of the standard color values X, Y, Z in a Hunter three-filter photometer. The symbols $W_B$, X, Y and Z are defined as follows:

$$W_B = R_Y + 3(R_Z - R_X)$$
$$X = 0.783\ R_X + 0.198\ R_Z$$
$$Y = R_Y$$
$$Z = 1.182\ R_Z$$

The following Examples are intended to illustrate the invention without limiting it in any way. All parts and percentages are be weight, unless otherwise stated.

EXAMPLE 1

(a) Dry spinning 700 kg dimethyl formamide (CMF) are mixed with 300 kg of an acrylonitrile copolymer (K value 81) of 93.6% acrylonitrile, 5.7% methyl acrylate and 0.7% sodium methallyl sulfonate while stirring in a tank at room temperature. The suspension was pumped by a gearwheel pump into a stirrer-equipped spinning tank. The suspension was then heated with steam at 4 bar in a double-walled tube. The residence time in the tube was 5 minutes. The spinning solution, which has a temperature of 138° C. and a viscosity of 19 falling-ball seconds (8.30 Pa.s) as measured at 100° C. on leaving the tube, was cooled to 90° C. after leaving the heating unit, filtered and fed directly to a spinning plant comprising 60 spinning tubes.

The spinning solution was spun at a take-off rate of 150 m/minute from 1380-bore spinnerets with a bore diameter of 0.20 mm. 45 kg water-free, superheated steam at 400° C. was injected into each spinning tube above the spinneret longitudinally of the filaments. The tube wall temperature was 240° to 243° C. The spinning tube output was 11.7 kg PAN solids per tube per hour. The throughput ratio of PAN solids to superheated steam was thus 1:3.8. In the spinning tubes at a distance of approximately 50 mm from the lower end, the slivers were wetted through two vertically offset and opposite slot dies, of the type described in applicants' German patent application DE 3 515 091, with an aqueous, oil-containing, antistatic 40% finish at 70° to 90° C. in such a way that the filaments has an oil content of approximately 0.20% by weight, an antistatic content of approximately 0.05% by weight and a moisture content of 13.2% by weight, based on fiber solids content. The temperature of the spun filaments, as measured immediately beneath the spinning tubes, was approximately 129° C. The tow obtained by directly combining the tube slivers from 60 spinning tubes has a total denier of 777 600 dtex and a residual solvent (DMF) content of 0.7% by weight, based on the solids content.

(b) Continuous aftertreatment (non-HS fibers)

Immediately afterwards, the hot tow was passed over a stretching septet heated to 130° C. for temperature adaptation and stretched by 360%, a stretching septet with heatable rollers serving as the second nip point. The tow had a stretching temperature of 116° C., as measured with a KT 15 radiation thermometer. Immediately afterwards, the stretched tow was fed to a blow crimper integrated in steam-tight manner in a short perforated-belt steamer and operated with superheated steam at 160° C. The steam used in the blow crimper served both to crimp and to relax the tow. The residence time in the steamer was 30 seconds and the temperature 125° C. The fully shrunk tow was then cooled, cut to 60 mm staple fibers, blown and baled.

The acrylic fibers continuously produced in this way have an individual fiber denier of 3.3 dtex. The fibers have a strength of 3.0 cN/dtex and an elongation of 21%. The fibers are completely vacuole-free and, after boiling or treatment with saturated steam, are also completely vacuole-stable. The fibers no longer shrink on boiling and have a Berger whiteness of 56.9. The density of the fibers is 1.183 g/cm$^3$ and, after treatment for 10 minutes in boiling water, 1.181 g/cm$^3$. The fibers can be further processed at 100 m/minute in a high-performance card.

(c) Continuous aftertreatment (HS fibers)

Immediately after (a), the hot tow is cooled with compressed air in countercurrent to approximately 110° C. in a 3 meter long air zone and is then passed over a stretching septet heated to 100° C. for temperature adaptation. The tow assumes a temperature of 107° C., as measured with a Heimann KT 15 radiation thermostat. The tow was then stretched by 250%, a stretching septet comprising heatable rollers serving as the second nip point. The tow temperatures after stretching are 39° to 40° C. Immediately afterwards, the stretched tow was delivered to a chamber of the type described in Applicants' German patent application DE-A 3 631 905, the opening of the crimping chamber exit being larger than the opening of the crimping chamber entrance after the intake rollers. The crimped tow is then cooled with circulated air at room temperature on a perforated belt, cut to 75 mm long high-shrinkage staple fibers and baled.

The high-shrinkage acrylic fibers thus produced in a continuous process had an individual fiber denier of 3.7 dtex. The fibers had a boiling-induced shrinkage, as determined in boiling water of 43.3%, a strength of 1.9 cN/dtex and an elongation of 32%. The density is 1.181 g/cm$^3$ before boiling and 1.175 g/cm$^3$ after boiling. The fibers could be processed at 100 m/minute in a high-performance card. The short and long fiber material in a staple diagram amounts of less than 3%. The substantially dry fibers are stable in storage an show unchanged high-shrinkage properties after storage of 3 months at temperatures of up to 40° C. The berger whiteness is 55.1.

Tests involving various tow temperatures and degrees of stretching were carried out for spun material having the same overall denier of 777 600 dtex and the shrinkage behavior determined. The high-shrinkage fibers are otherwise produced in the same way as in Example 1. A boiling-induced fiber shrinkage of more than 35% is only obtained with degrees of stretching of up to 400% and at tow temperatures of up to 120° C. At very low temperatures, for example 80° C., the spun material seems only to be "cold-extended". If the stretching temperature or the stretching limits are exceeded, the high-shrinkage fibers are no longer obtained. Wraps and breaks occur frequently in the stretching zone. In every case, a density of more than 1.170 g/cm$^3$ is observed before an after treatment for 10 minutes with boiling water,

EXAMPLE 2

After stretching by 360%, part of the travelling tow of Example 1, overall denier 777 600 dtex, was fed to a high-speed stuffer-box crimper of the type described in Applicants' DE-A 3 631 905 and crimped at a speed of 540 m/minute. The crimped tow, which had a filament weight of 21.6 g/m, was then relaxed for 30 seconds with hot air at 180° C. in a short tube connected to the stuffer box in gas-tight manner. The fully shrunk tow was then cooled, cut to 60 mm long staple fibers, blown and baled.

The individual fiber denier was 3.3 dtex; fiber strength=2.9 cN/dtex; fiber elongation=23%. The fibers no longer shrink on boiling and have a favorable Berger whiteness of 51.6. Their density is 1.181 g/cm$^3$ before and 1.179 g/cm$^3$ after boiling for 10 minutes. The fibers can be further processed at 120 m/minute in a high-performance card.

A spinning solution was prepared in accordance with Example 1 and spun in an individual spinning tube of the same dimensions. In a series of tests, the quantity of spinning steam was varied and the particular DMF content of the spun filaments determined. All other parameters remained constant.

TABLE 1

| Example No. | 1 | 2 | 3 | 4 | 5 | 6 |
|---|---|---|---|---|---|---|
| Quantity of steam kg/h | 23 | 29 | 35 | 41 | 47 | 53 |
| PAN/steam ratio | $\frac{1}{2}$ | 1.2.5 | $\frac{1}{3}$ | $\frac{1}{3}$.5 | $\frac{1}{4}$ | $\frac{1}{4}$.5 |
| DMF content (%) of the spun filaments | 5.4 | 3.1 | 1.9 | 1.2 | 0.5 | 0.2 |
| Remarks: | comparison | comparison | invention | invention | invention | invention |

As can be seen from Table 1, the PAN solids/steam ratio has to be at least 1:3 to obtain residual solvent contents in the spun material of less than 2% by weight, based on PAN solids (for a given tube diameter of 280 mm).

EXAMPLE 3 (Comparison)

(a) A PAN spinning solution prepared in accordance with Example 1 was spun through a single spinning tube as described in that Example. However, the spun filaments were not finished in the spinning tube. The filaments become electrically charged, turn dark brown in color on leaving the spinning tube and begin partly to glow on the bobbins unless quenched with water. The filament exit temperature was at least 158° C.

If, therefore, the filaments are spun without wetting with water in the tube under the high thermal stress spinning conditions of the process according to the invention, totally unacceptable results were obtained.

(b) Filaments according to Example 3*a* were finished with water or an aqueous oil-containing finish outside the spinning tube. Filaments breaks and sloughing occurred constantly between the end of the tube and the finishing unit. The spun filaments had a rough an brittle surface with a poor natural color and could only be produced for a short time. An aqueous finish applied outside the tube produced filaments with unsatisfactory behavior.

(c) In a series of tests, the amount of finish in the form of water or an aqueous finish containing an antistatic agent and lubricant was determined on spun filaments produced in accordance with Example 1, the temperature of the filaments immediately after leaving the spinning tube was measured and the spinning process as a whole was evaluated. As can be seen from Table 2, moisture contents of more than 10% by weight are necessary and filament temperatures of at most 130° C. are acceptable for guaranteeing satisfactory further processing of the spun material.

TABLE 2

| | Air spinning | | | | | | | |
|---|---|---|---|---|---|---|---|---|
| | Example No. | | | | | | | |
| | 1* | 2 | 3 | 4 | 5* | 6 | 7 | 8 |
| Finish | water | water | water | water | finish | finish | finish | finish |
| Quantity ml/min. | 85 | 80 | 70 | 60 | 90 | 80 | 70 | 60 |
| Moisture % content of filaments | 10.7 | 9.7 | 8.6 | 7.8 | 12.8 | 9.5 | 8.3 | 7.6 |
| Oil applied % to filaments | — | — | — | — | 0.20 | 0.18 | 0.16 | 0.15 |
| Filament temp. °C. | 128 | 135 | 137 | 138 | 129–130 | 136 | 140 | 142 |
| spinning behavior | good offwinding and further processing | tow begins to stiffen, filament too dry | rough, brittle, filament fluffy | rough brittle filament, no tow cohesion | good offwinding and further processing | tow begins to stiffen, filament too dry | rough, brittle, filament fluffy | rough brittle filament, no tow cohesion |
| Remarks | *invention | comparison | comparison | comparison | invention | comparison | comparison | comparison |

We claim:

1. In the production of filaments and fibers of an acrylonitrile polymer containing at least 40% by weight of acrylonitrile units by spinning and aftertreatment, in which a spinning solution of the polymer in a highly polar organic solvent is spun with superheated steam in a spinning tube, most of the spinning solvent is evaporated in the spinning tube and, after finishing, the tow obtained by combining several filaments is subjected to continuous aftertreatment by stretching, crimping and shrinking, the improvement wherein prior to such aftertreatment (a) the fibers are spun at outputs of <20 kg/tube/hour, (b) superheated steam substantially free from water droplets is used as the spinning gas, (c) the amount of spinning steam used amounts to at least 20 kg/tube/hour, (d) the ration by weight of acrylonitrile polymer to the throughput of spinning steam is at least 1:3, (e) the spinning steam temperature is at least 360° C., (f) the spinning tube temperature is at least 230° C., (g) and the filaments are finished at the lower end of the spinning tube either with water or with an aqueous, or an aqueous oil-containing preparation containing an antistatic agent for bundling to promote cohesion, the moisture content of the filaments is more than 10% by weight, based on fiber solids, and the filament temperature on leaving the spinning tube is at most 130° C.

2. A process as claimed in claim 1, wherein in (c) the amount of spinning steam amount to between 35 and 80 kg/tube/hour.

3. A process as claimed in claim 1, wherein in (d) the weight ration of acrylonitrile polymer to spinning steam is from 1:3 to 1:5.

4. A process as claimed in claim 1, wherein in (e) the spinning steam temperature is at least 400° C.

5. A process as claimed in claim 1, wherein in (f) the spinning tube temperature is from 240° to 245° C.

6. A process as claimed in claim 1, wherein in (g) the filament temperature on leaving the spinning tube is below 120° C.

7. A process as claimed in claim 1, wherein the steam used in (b) is substantially free from droplets after the removal of water.

8. A process as claimed in claim 1, wherein the superheated steam used to evaporate the spinning solvent in (b) is introduced through a spinning gas distributor at the head of the spinning tube.

9. A process as claimed in claim 1, wherein immediately after spinning, the filaments are continuously treated by stretching, crimping, with or without shrinking or cutting, (h) the filaments coming into contact in the spinning tube with no other washing or extraction liquid for the spinning solvent than the water of the finish throughout the entire process, (i) the tow temperature during stretching being at least 90° C. and (j) the stretching ratio being from 1:2 to 1:15.

10. A process as claimed [illegible] claim 9, wherein in (j) the stretching ratio is from 1:[illegible] 1:12.

11. A process as claimed in claim 9, wherein after stretching the tow is crimped in a stuffer box crimper or in a steam-operated blow crimper, the shrinkage in the filaments then being reduced to <35% by treatment with hot air or steam at ≧100° C.

12. A process as claimed in claim 11, wherein the shrinkage of the filaments is reduced to 0 to 3%.

13. A process as claimed in claim 9, wherein to produce high-shrinkage fibers and filaments with >35% shrinkage, the spun filaments are stretched in a ratio of 1:2.5 to 1:4.0 at a temperature of 90° to 120° C. without using a liquid bath, and crimped in a stuffer box crimper.

14. A process as claimed in claim 1, wherein the process is carried out with a tow of at least 100,000 dtex.

15. A process as claimed in claim 13 wherein the spun filaments are cooled to 90° to 120° C. prior to stretching.

* * * * *